US010823507B2

(12) United States Patent
Tockert et al.

(10) Patent No.: US 10,823,507 B2
(45) Date of Patent: Nov. 3, 2020

(54) MATERIAL HOPPER, IN PARTICULAR FOR A BLAST FURNACE

(71) Applicant: PAUL WURTH S.A., Luxembourg (LU)

(72) Inventors: Paul Tockert, Berbourg (LU); Chris Kaufmann, Hobscheid (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 16/336,285

(22) PCT Filed: Sep. 18, 2017

(86) PCT No.: PCT/EP2017/073510
§ 371 (c)(1),
(2) Date: Mar. 25, 2019

(87) PCT Pub. No.: WO2018/054848
PCT Pub. Date: Mar. 29, 2018

(65) Prior Publication Data

US 2019/0219335 A1 Jul. 18, 2019

(30) Foreign Application Priority Data

Sep. 23, 2016 (LU) ..... 93234

(51) Int. Cl.
*F27D 3/10* (2006.01)
*C21B 7/20* (2006.01)
*F27B 3/18* (2006.01)

(52) U.S. Cl.
CPC ..... *F27D 3/10* (2013.01); *C21B 7/20* (2013.01); *F27B 3/183* (2013.01)

(58) Field of Classification Search
CPC ..... B65D 88/28; B65G 11/16; B65G 11/166; B65G 47/44; C21B 7/20; F27B 1/20; F27B 3/183; F27D 3/10; F27D 5/0062
See application file for complete search history.

(56) References Cited

U.S. PATENT DOCUMENTS 3,651,964 A * 3/1972 Nieboer ..... C21B 7/18 414/202
4,040,530 A * 8/1977 Mahr ..... C21B 7/18 414/208

(Continued)

FOREIGN PATENT DOCUMENTS

EP 1811045 A1 7/2007
GB 2047212 A 11/1980

(Continued)

OTHER PUBLICATIONS

International Search Report dated Oct. 17, 2017 re: Application No. PCT/EP2017/073510; pp. 1-3; citing: EP 1 811 045 A1, GB 2 047 212 A and JP 2013 086890 A.

(Continued)

*Primary Examiner* — James Keenan
(74) *Attorney, Agent, or Firm* — Cantor Colburn LLP

(57) ABSTRACT

A Material hopper, in particular for a blast furnace, includes a containing hollow shell for storing material, the shell having an upper shell part with an inlet portion and an asymmetric funnel-shaped lower shell part with an outlet portion, a wear plate arrangement covers at least part of an inner wall of the lower shell part, the wear plate arrangement having a plurality of wear plates arranged adjacent to one another in a plurality of rows stacked along the inner wall, the wear plates being arranged in rows that follow parallel mounting lines that are defined by the intersection of the lower shell part with planes perpendicular to the axis of a (Continued)

virtual right circular cone substantially matching the shape of the funnel-shaped lower shell part.

9 Claims, 4 Drawing Sheets

(56) References Cited

U.S. PATENT DOCUMENTS

| | | | | |
|---|---|---|---|---|
| 4,869,622 | A * | 9/1989 | Salter | B01J 3/02<br>406/119 |
| 8,092,136 | B2 * | 1/2012 | Lonardi | F27D 3/0032<br>414/206 |
| 8,152,430 | B2 * | 4/2012 | Lonardi | C21B 7/20<br>414/206 |
| 8,485,336 | B2 * | 7/2013 | Tenold | B65G 11/166<br>193/2 R |

FOREIGN PATENT DOCUMENTS

| | | | |
|---|---|---|---|
| JP | 2013086890 | A | 5/2013 |
| WO | 2007082630 | A1 | 7/2007 |

OTHER PUBLICATIONS

Written Opinion dated Oct. 17, 2017 re: Application No. PCT/EP2017/073510; pp. 1-5; citing: EP 1 811 045 A1, GB 2 047 212 A and JP 2013 086890 A.

* cited by examiner

Prior Art

MATERIAL HOPPER, IN PARTICULAR FOR A BLAST FURNACE

TECHNICAL FIELD

The present disclosure relates to the field of material storage. The present disclosure more specifically relates to a material hopper, in particular for the storage of raw material in a shaft or furnace.

BACKGROUND

The construction of modern high production blast furnaces has imposed new and more stringent demands on the charging arrangement due, in part, to the increased dimensions of the hearth within the furnace over which the charge must be uniformly distributed.

During charging operations, skips or a conveyor belt carry the charge material to one or more material hoppers arranged at the top of the blast furnace. Upon filling of the given hopper, it is sealed and pressurized to the furnace top operating pressure. Such material hoppers have conventionally been in the form of sluice bins, which deliver materials to a centrally arranged spout before entering the furnace throat.

The release of the charge material held in the material hoppers is controlled accurately by means of material gates in order to optimize the quantity of material needed for the chemical reaction that is taking place in the furnace hearth.

Modern BELL-LESS TOP furnaces use one, two or three material hoppers. In multiple hopper configurations, the hoppers are used alternately; one is being filled and acts as temporary storage while another is being emptied. A third hopper can be provided to be used in case maintenance is required on one of the two working hoppers, or to provide a maximum flexibility of charging options whilst retaining overcharge or catch-up capacities in excess of 50%.

In order to reduce the overall bulk of the installation, the hoppers are arranged close to each other and are shaped to offer the largest containing volume. Such multiple-hopper BELL-LESS TOP charging installation is, e.g., disclosed in WO2007/082630.

Accordingly, a state of the art charging installation for a shaft furnace comprises a distribution device for distributing material in the shaft furnace, in particular a pivotable chute, symmetrically arranged about a central axis of the shaft furnace, and at least two hoppers arranged in parallel and offset from the central axis above the distribution device for storing material to be fed to the distribution device.

FIG. 1 represents a partially cut view of a material hopper for the charge and discharge of raw material in a blast furnace as known in the state of the art. The material hopper 10 comprises a containment shell 12 with an inner wall 14 and an outer wall 16. The shell 12 is made by a superposition of two truncated conical parts connected through a central cylinder 18: an upper cone 20 comprises an upper aperture 22 at its top, covered by an upper seal valve 24 cooperating with distribution rocker fed by a conveyor belt or skip car (not shown); and a lower cone 26 having a connecting end 27 attached to the centre cylinder 18 and ending at its bottom in an outlet portion 28, through which material is discharged to the downstream central chute arrangement, not shown.

As represented in FIG. 1, the hopper 10 is off-centred with respect to an axis C corresponding to the central axis of the central chute arrangement. Each hopper 10 is disposed in a radial symmetrical position from said central axis of the chute arrangement. The lower cone 26 is configured asymmetrically with its outlet portion 28 being eccentric and arranged proximate to the central axis C. For the purpose of description, an inner side 30 of the hopper will refer to the region that is, in use, proximate to the central axis C of the chute arrangement, whereas an outer side 32 will refer to the opposite region.

In a charging operation, a flow of charge material enters the upper cone 20 through the upper aperture 22, falls onto the inner wall 14 of the shell 12 and piles up in the hopper 10. Because of the large size of the hopper 10, the flow of material is susceptible to fall on the inner wall 14 from a height of several meters. The hopper 10 commonly comprises a cast wear plate lining, generally indicated 34, to protect the inner wall 14 against the impact of the material repeatedly falling from the upper aperture 22 during charging operations. The wear plates lining 34 usually comprises a plurality of cast wear plates 36. The cast wear plates 36 are at least arranged in an area referred to as 'impact area' 38, which directly receives the incoming flow of material.

In a discharging operation, the flow of material exits the hopper 10 through the outlet portion 28. The shape of the hopper 10 is adapted to direct the flow of material, and to reduce the wear zones in downstream located conducts by offering flow condition giving a level of radial symmetry out of the hopper as close as possible to the one associated with a single hopper central feed furnace.

Accordingly, the asymmetric configuration of the lower shell part 26 allows having the outlet portion 28 closer to the furnace's central axis C. Since the outlet portion 28 and upper aperture 27 of the lower shell part 26 are conventionally of circular shape and located in substantially horizontal planes, the lower shell part 26 forms a truncated oblique cone.

The cast wear plates 36 are affixed to the impact area 38 in a series of stacked horizontal rows substantially from top to bottom of the lower cone 26, following circular horizontal mounting lines represented in FIG. 1 by broken lines 40. As it will be understood, in order to uniformly cover the inner wall 14, each of the cast wear plates has a unique shape.

The inconvenient of such a cast wear plates lining 34 inside the hopper is that it requires a great variety of components, which involves high production costs. This problem further affects particularly cast wear plates suppliers and users because they need to manage more complex stocks of wear plates.

BRIEF SUMMARY

It is therefore desirable to provide an improvement to the solution used to build material hoppers. More particularly, the disclosure provides for an improved solution for the cast wear plates lining used to cover the impact area inside the lower cone of the material hoppers.

The present disclosure proposes a material hopper, in particular for a blast furnace.

The present disclosure overcomes the above discussed deficiencies and disadvantages by providing a material hopper, in which the wear plates provided in the asymmetric, funnel-shaped lower shell part of the material hopper are arranged along mounting lines defined with reference to a virtual right circular cone substantially matching the shape of the lower shell part. In particular, the wear plates are arranged in rows that follow parallel mounting lines that are each defined by the intersection of the lower shell part with a plane perpendicular to the axis of a virtual right circular cone substantially matching the shape of the funnel-shaped lower shell part.

The virtual right circular cone, also herein referred to as 'virtual cone', is a mathematical approximation of the shape of the lower shell part, which is typically designed based on an oblique circular cone. Hence the virtual right circular cone fits closely to the inner (or outer) shape of the lower shell part. It is virtual in the sense that it is used for the layout of the wear plates, but there is no element embodying this cone in the hopper.

The advantage of using such virtual cone is that, by definition, planes perpendicular to the axis of the vertical cone intersect with the lateral surface of the cone to define circles (here the mounting lines) that are spaced by the same distance on the surface of the cone, at any point of the periphery. The cast wear plates are thus arranged on a circular row that has an axis of circular symmetry: the axis of the virtual cone. Although the mounting lines as used in the present disclosure will, in practice, be tilted relative to the vertical (and as compared to horizontal mounting lines shown in FIG. 1), they bring a noticeable advantage due to the regular distance between mounting lines. As a result, in the present material hopper the wear plates in a same row can have the same shape and dimensions. This has remarkable benefits in that it reduces stock handling and facilitates mounting.

It will appear that the present disclosure is not limited to the domain of blast furnaces or iron/steel making, but it can be used in any industry where is desirable to provide a wear plate arrangement inside a material hopper. Furthermore, the teachings of the present disclosure are applicable in the construction of new material hoppers, but can also be applied in existing material hoppers.

Conventionally, the wear plates may be made from pig iron or steel, by casting—whereby they may be referred to as 'cast wear plates'. This should however not be considered limiting; wear plates can be manufactured from other materials, as appropriate depending on the intended use.

Apart from the wear plates arrangement, the design of the material hopper can be relatively conventional. For example, the material outlet of the lower shell part may be vertically oriented to produce a substantially vertical outflow of material and has a circular cross-section in the horizontal plane.

Also, the lower shell part may typically have an upper connecting end by which it connects with the upper shell part, preferably through a cylindrical centre part. The connecting end has a circular cross-section in the horizontal plane; and the connecting end is eccentric to said material outlet.

As indicated above, thanks to the disclosure all the cast wear plates in a given row can have the same shape. Preferably, the curvature and the width of the wear plates in the circumferential direction are predetermined in a manner that the final cast wear plates lining offers a minimal deviation from the shape of a circle in each row.

Preferably, the wear plates arrangement is provided to cover at least an impact area of the inner wall of the lower shell part. Indeed, the wear plates are primarily arranged to cover the so-called impact area of the hopper, i.e. the wall region of the shell that faces the inlet opening and directly receives the incoming flow of material. It is however also possible to cover the whole inner periphery of the hopper with wear plates. Inner wall regions not covered by wear plates may be provided with a lining of ceramic tiles, as is known in the art.

Each wear plate comprises a curved body having a front side facing the inside of the hopper, an opposite rear side by which it is mounted against the inner wall of said lower shell part. Preferably, the front side of the wear plate is provided with horizontal grooves that permit accumulation of material therein, thereby reducing wear of the front side.

To facilitate the mounting of the wear plates, the longitudinally extending lateral edges of the wear plate have a convex V-shaped profile.

BRIEF DESCRIPTION OF THE DRAWINGS

Further details and advantages of the present disclosure will be apparent from the following detailed description of not limiting embodiments with reference to the attached drawing, wherein.

DESCRIPTION OF PREFERRED EMBODIMENTS

A state of the art material hopper has been described above with reference to FIG. 1. As it is known in the art, such material hopper is designed for use in a parallel-hopper type charging installation (in particular BELL-LESS TOP) at the top of a blast furnace. As is known per se, such charging installation comprises a rotary distribution device arranged as top closure of the throat of the blast furnace. For distributing bulk material inside the blast furnace, the distribution device comprises a chute serving as distribution member. The chute is arranged inside the throat so as to be rotatable about the vertical central axis of the blast furnace and pivotable about a horizontal axis perpendicular to the vertical axis.

Figure 1:
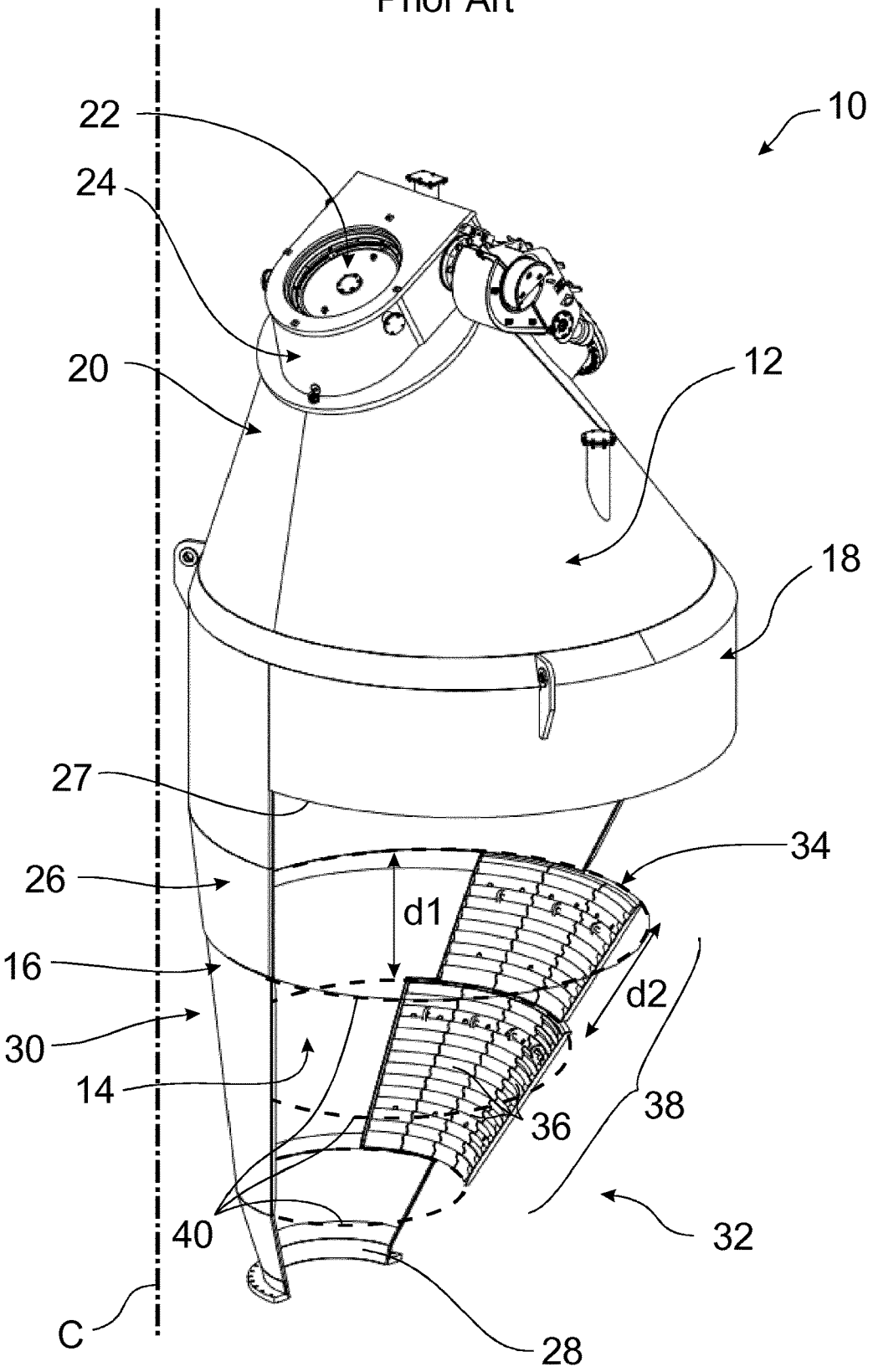
FIG. 1 is a partially cutaway view of a material hopper according to the state of the art.

The charging installation further comprises a pair of material hoppers—of the type shown in FIG. 1—arranged in parallel above the distribution device and offset from the central axis of the furnace. In a manner known per se, the hoppers serve as storage bins for bulk material to be distributed by the distribution device and as pressure locks avoiding the loss of pressure in the blast furnace by means of alternatively open and closed upper and lower sealing valves. Each hopper may have a respective material gate housing at its lower end. A common sealing valve housing is arranged in-between the material gate housings and the distribution device and connects the hoppers via the material gate housings to the distribution device. This is only an example and other configurations can be selected, as it will be clear to those skilled in the art. For example, the seal valve and material gate may be arranged in the same housing.

Figure 2:
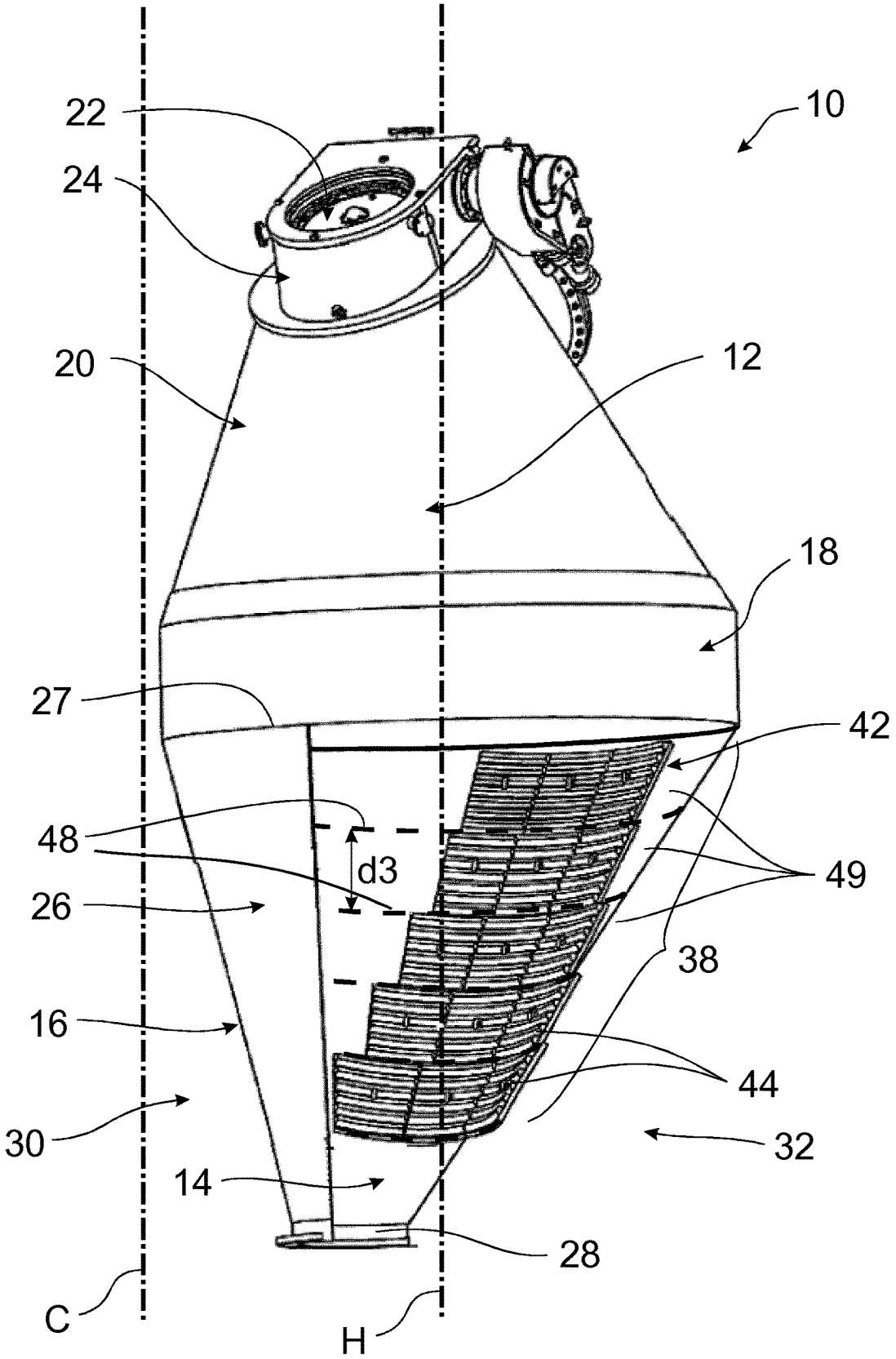
FIG. 2 is a partially cutaway view of a material hopper according to an embodiment of the disclosure.

Turning now to FIG. 2, there is shown an embodiment of the present material hopper 10' for blast furnace charging installation. Material hopper 10' in FIG. 2 is essentially identical to the one shown in FIG. 1, except for the arrangement of the wear plates. The same reference signs are therefore used to designate same or similar elements.

In FIG. 2, one will recognize the material hopper 10' with its containment shell 12 including a generally frusto-conical upper shell part 20, a substantially cylindrical center shell part 18 and a funnel-shaped lower shell part 26. The lower shell part 26 is sealingly attached to the center part 18 by a top connecting end 27 and ends, at its lower end, in an outlet portion 28. The outlet portion 28 is arranged vertically to produce a substantially vertical outflow of material and has a circular cross-section in the horizontal plane. The outlet portion 28 may be designed as a circular sleeve or ring. As can be seen in FIG. 2, the configuration of the hopper 10' in general, and the lower shell part 26 in particular, is asymmetrical with respect to a central axis H of the hopper 10' (i.e. the axis of the circular cylinder defining the center part 18). More precisely, with respect to axis H, the outlet portion 28 is eccentric such that it can be arranged in close proximity of the central axis C of the blast furnace. It will be understood that to achieve this effect, the shape of the upper part 20 and the center part 18 need not necessarily be as shown in FIG. 2, however outlet portion 28 is arranged eccentrically.

When raw material is fed into the empty hopper 10', the incoming flow of material falls onto the portion of the lower shell part 26 opposite/facing the inlet aperture 22, this region being referred to as impact area and designated 38. To avoid wear of the shell itself, the inner wall 14 is covered, at least in the impact area, with an arrangement 42 of wear plates 44, affixed to the inner wall 14. Conventionally, wear plates are manufactured by casting from pig iron, and are thus also typically referred to as cast wear plates. Although cast wear plates will typically be used in the present hopper 10', the present wear plate arrangement may also be used with wear plates made from different materials.

Referring back to FIG. 1, and as already explained, wear plates 44 have conventionally been mounted along circular mounting lines (40 in FIG. 1) parallel to the aperture plane of the outlet portion 28, i.e. horizontally. A major drawback of this conventional arrangement is that, since the lower cone 26 has an asymmetric funnel shape, the distance (as measured on the inner wall 14) between two parallel horizontal mounting lines 40 varies depending on the angular position with regard to the center of the circular mounting line. For example, distance $d_1$ between two adjacent mounting lines 40 as measured along inner wall 14 is smaller than $d_2$. Hence, all wear plates 44 must have a unique shape.

By contrast to FIG. 1, the present material hopper 10' as shown in FIG. 2 has a wear plate lining 42 that is arranged according to tilted circular mounting lines 48 that are defined by means of a virtual right circular cone, as will now be explained with reference to FIGS. 3 and 4.

Figure 3:
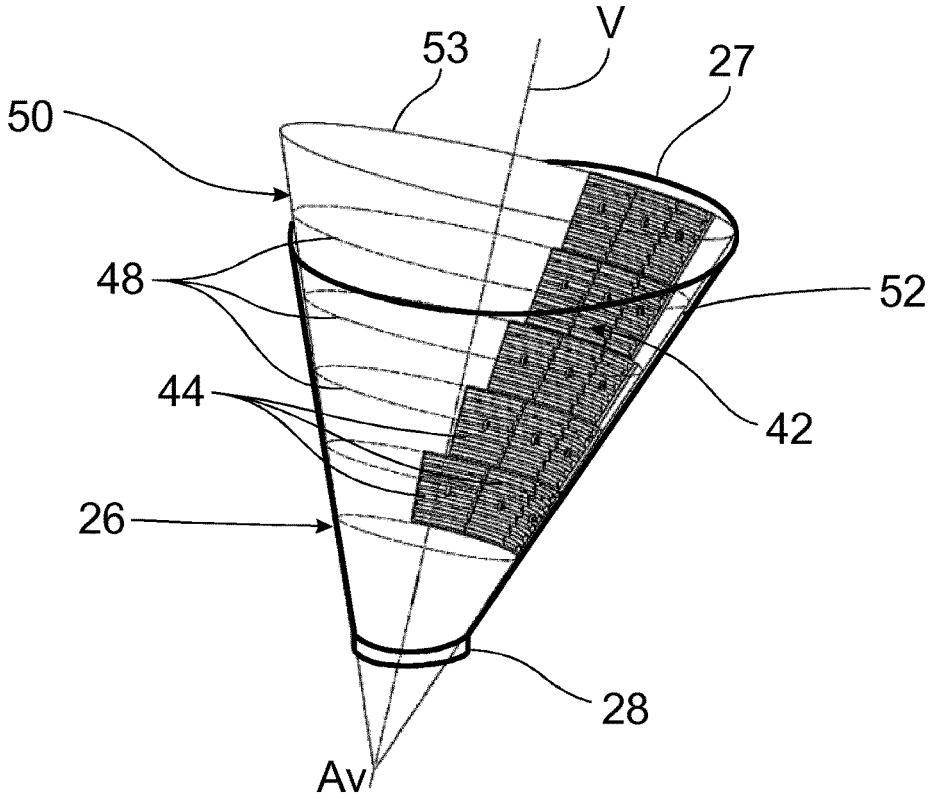
FIG. 3 is a principle perspective view illustrating the cast wear plates arrangement in the lower shell of the present material hopper.
Figure 4:
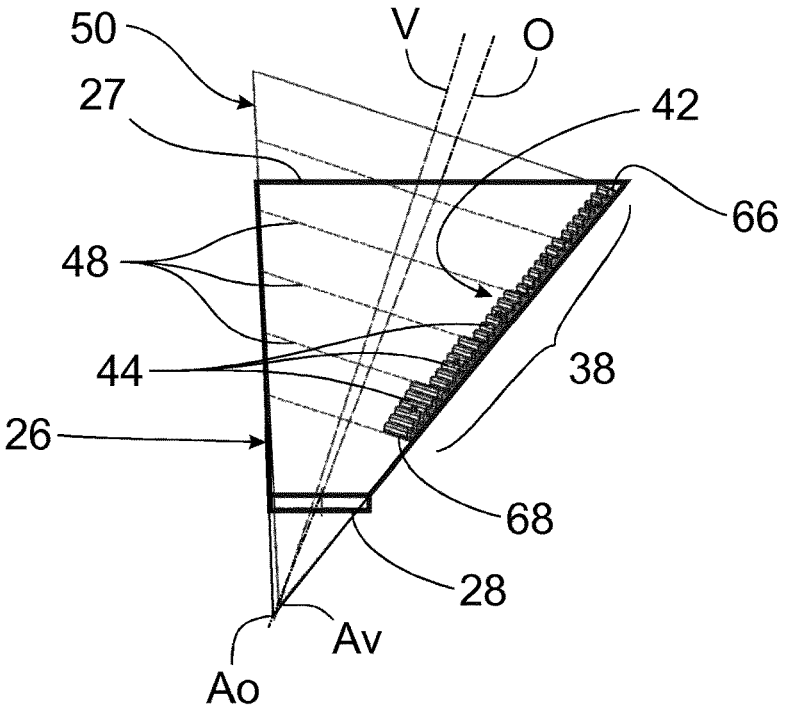
FIG. 4 is a side view of FIG. 3.

In FIGS. 3 and 4 one will recognize the funnel-shaped lower shell part 26 with its lower outlet portion 28 and its upper connecting end 27. The outlet portion 28 and connecting end 27 are both circular (by design) and extend in parallel horizontal planes, but are eccentric, which leads to this asymmetric funnel shape of the lower shell part 26. Mathematically speaking, the lower shell 26 forms a truncated oblique cone: the apex of the corresponding cone is not over the center of the circular base corresponding to connecting end 27. The apex of the truncated oblique cone is noted $A_O$ in FIG. 4 and is classically determined as the intersection of the generatrix of the lateral surface formed by the lower shell part 26. The axis of the oblique cone, which passes through the centre of the outlet portion and of the connecting end 27, is designated O.

Reference sign 50 designates a virtual right circular cone (virtual in the sense that it is used for design purposes but does not correspond to a solid conical element). This right circular cone 50 is designed to match—as close as possible—the funnel shape of the lower shell part 26. That is, the virtual cone 50 is dimensioned as the right circular cone that approaches best the truncated cone shape of the lower shell 26; or in other words that fits best inside the lower shell part 26 to come as close as possible to inner wall 14. To some extent, it may be seen as a right circular cone inscribed in the lower shell part 26. The virtual cone 50 has an axis V and an apex Av. By definition, its axis V passes through the center of its circular base, materialized in the figures by line 53, and is perpendicular thereto. It may be noted in passing that the due to the asymmetric funnel design of the lower shell part 26, the axis O is typically tilted relative to the vertical; and the virtual cone 50, respectively its axis V, will generally also be inclined relative to the vertical.

It shall be appreciated that the virtual cone 50 is used herein to define the mounting lines 48 of the wear plates 44 inside the lower shell part 26: each mounting lines 48 is defined as the intersection of a respective plane perpendicular to the virtual cone axis V with the lower shell part 26 designed as truncated oblique cone. Hence, the mounting lines 48 are tilted with respect to the conventional, horizontal mounting lines 40, but since they are in planes perpendicular to the axis $A_V$ of a right circular cone, the mounting lines 48 are circular. Consequently, the distance (as e.g. represented by d3) between any pair of mounting lines 48 on the inner wall 14 is the same at any angular position with regard to the centre of the mounting line. The wear plates 44 arranged in a given row, i.e. along a same mounting line 48, may thus be designed to have the same shape.

As the inner wall 14 is built upon an oblique circular cone whilst the virtual cone 50 is a right circular cone, the two cones cannot perfectly superpose. The virtual cone 50 is yet optimized to be as close as possible to the oblique cone of the lower part 26. As will be understood, the practical consequence is that a narrow gap 52 will exist between the two cones, which may be easily compensated if necessary by jointing means or through the fixing means. This gap is however minor since the axes $A_V$ and $A_O$ of the cones have small deviations, as shown in FIG. 4.

Advantageously, the virtual cone 50 is designed to be entirely comprised in the volume of the lower cone part 26. In that manner, the surface of the virtual cone 50 is always accessible inside the original cone of the inner wall 14 to place the cast wear plates arrangement 42. In practice, the conical shape of the lower part 26 is very close to the virtual cone 50, leaving only a narrow gap 52 between the two cones, as shown on FIG. 3.

As can be seen in the figures, the wear plates 44 are arranged in rows, against the inner wall 14 of the lower shell part 26, but oriented following the mounting lines 48 determined by means of the virtual cone 50. The wear plates arrangement 42 then consist of a plurality of rows of wear plates 44 that are positioned on top of another in the direction of axis V, i.e. stacked, to cover the inner wall 14. One row is obtained e.g. by aligning the top edge of the wear plates 44 along a mounting line 48. It can also be said that one row is in-between two neighbouring mounting lines 48. In FIG. 2 rows are indicated 49.

The cast wear plates 44 are arranged closely together in order to cover uniformly the inner wall 14, meaning that there is no substantial gap between two adjacent cast wear plates 44.

Figure 5:
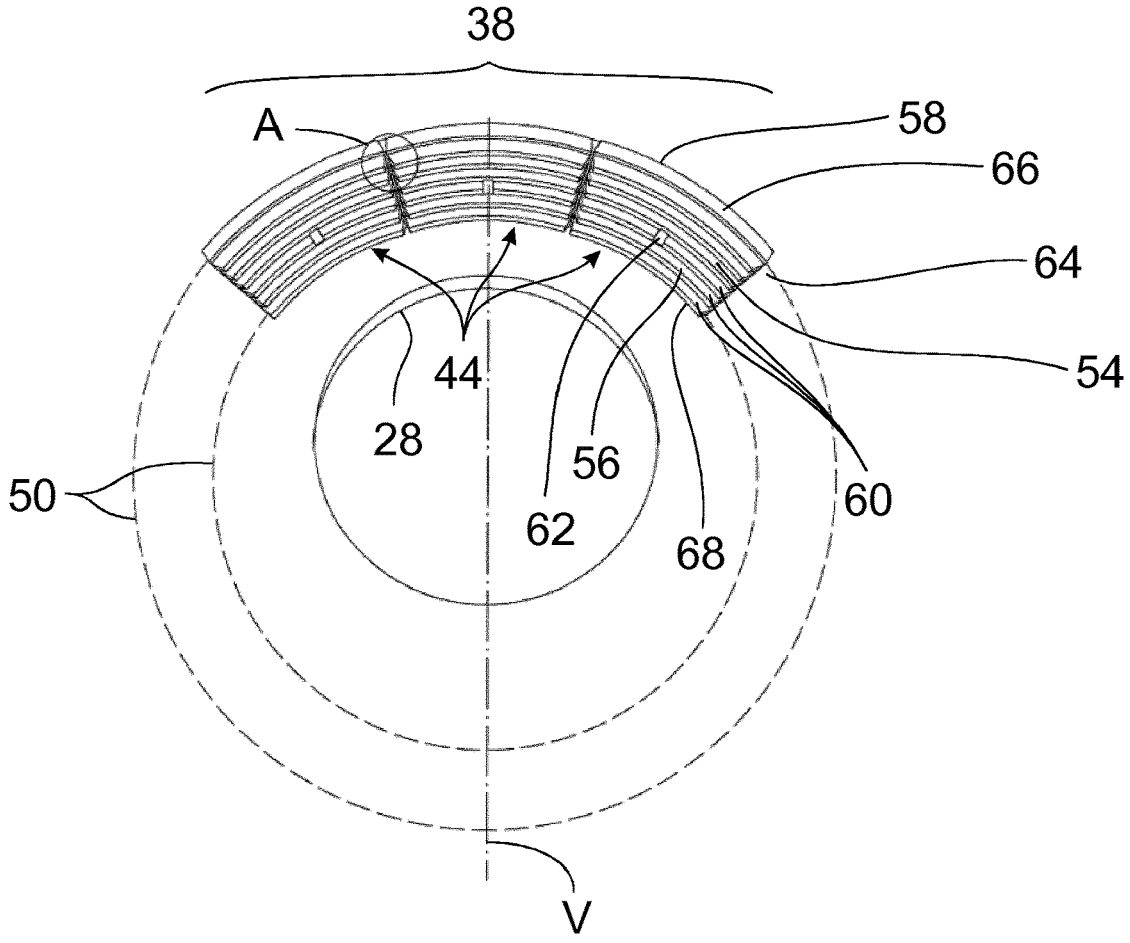
FIG. 5 is a principle top view of the cast wear plates arrangement in the lower shell of the present material hopper.

As better seen in FIG. 5, the wear plate 44, per se, typically consists of a curved body 54 having a front face 56 facing the interior of the hopper and an opposite rear face 58, by which it is mounted on the inner wall 14 using any appropriate means, e.g. bolts, screws, or solder joints. Preferably, the fixation means include three bolts that engage in corresponding holes in the inner wall 14. The front face 56 comprises a plurality of horizontal grooves 60, which allows accumulation of material and thereby reduces abrasion wear of the front side. Reference sign 62 designates a lifting member, e.g. a ring, hook or the like, that allows lifting/holding the wear plate during assembly.

As mentioned, the wear plate body 54 has a curved shape, i.e. the plate body 54 (not only the front face 56) is bent in a concave manner, seen from the front face 56, i.e. with lateral edges 64 brought forward. The curvature of the rear face 58 is advantageously designed to match the shape of the virtual right circular cone 50 in the row in which it is to be mounted.

Since the cast wear plates 44 are arranged in rows following a circular mounting line 48 and the axis V of the virtual cone 50 is a circular symmetry axis for each row, it follows that each cast wear plate 44 in a given row can be mounted interchangeably anywhere along the given mounting line 48. Also, all the cast wear plates 44 of a same row may have the same dimensions.

For the sake of exemplification, the overall dimensions of a cast wear plate 44 may be in the order of: 800 mm (width) by 900 mm (height), with a body having a thickness of about 100 mm. These dimensions are not limiting and those skilled in the art may adapt the dimensions as desirable.

In case a whole row is to be covered by cast wear plates, i.e. over 360°, the width of a cast wear plate may be defined so that the row can be covered by an integer umber of wear plates. In practice, it may be sufficient to arrange the cast wear plates in the impact area, or let's say in the outer side 32 of the hopper 10'.

The areas of inner wall 14 not covered by wear plates 44 may be covered by means of ceramic tiles (not shown), as is known in the art.

As can be seen in FIG. 5, the body has two longitudinally extending lateral edges 64 (i.e. extending axial direction of virtual cone 52) as well as a top and a bottom edge 66 and 68, typically parallel to the mounting lines 50. The top and bottom edges 66 and 68 are substantially straight walls, generally perpendicular to the rear face 58. The lateral edges 64 face adjacent wear plates 44 in a same row.

During mounting of the material hopper 10', the cast wear plate 44 is hung to a crane by means of the lifting member 62. As it will be understood, the wear plate needs to be manipulated in the radial direction by the operators, but it must also be inclined according to the tilted mounting lines 48.

Figure 6:
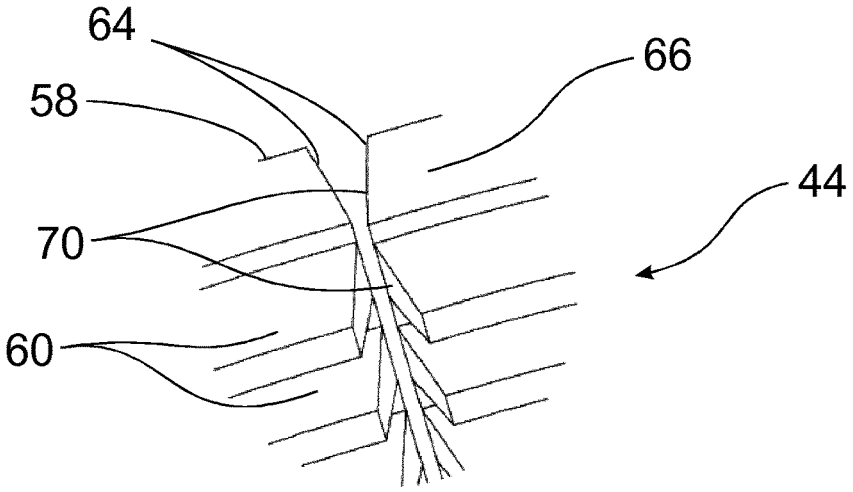
FIG. 6 is a close-up view of detail A in FIG. 5.

In order to facilitate the installation of the wear plates 44, the lateral edges 64 thereof are provided with a rotation facilitating profile. As shown in FIG. 6, the lateral edge 64 comprises two slanted faces 70 giving the lateral edge a convex, V-shaped profile. The V-shape allows the cast wear plate 44 to be easily rotated and put in place during the mounting process, namely when it is disposed between two fixed neighbouring plates.

The invention claimed is:

1. A material hopper comprising:

a containing hollow shell for storing material, said shell comprising an upper shell part with an inlet portion and an asymmetric funnel-shaped lower shell part with an outlet portion;

a wear plate arrangement covering at least part of an inner wall of said lower shell part, said wear plate arrangement comprising a plurality of wear plates arranged adjacent to one another in a plurality of rows, said rows being stacked along said inner wall, wherein said wear plates are arranged in rows that follow parallel mounting lines that are defined by the intersection of said lower shell part with planes perpendicular to an axis of a virtual right circular cone substantially matching the shape of said funnel-shaped lower shell part.

2. The material hopper according to claim 1, wherein a material outlet of said lower shell part is oriented vertically to produce a substantially vertical outflow of material and has a circular cross-section in a horizontal plane.

3. The material hopper according to claim 2, wherein said lower shell part has an upper connecting end by which it connects with the upper shell part;

said connecting end has a circular cross-section in the horizontal plane; and said connecting end is eccentric to said material outlet.

4. The material hopper according to claim 3, wherein said upper connecting end of said lower shell part connects with said upper shell part through a cylindrical center part.

5. The material hopper according to claim 1, wherein said virtual right circular cone is a cone fitting closely the inner wall shape of said lower shell part.

6. The material hopper according to claim 1, wherein all the wear plates arranged in a same row, along a same mounting line, have the same shape.

7. The material hopper according to claim 1, wherein each wear plate comprises a curved body having a front side facing the inside of the hopper, an opposite rear side by which it is mounted against the inner wall of said lower shell part, and longitudinally extending lateral edges having a convex V-shaped profile.

8. The material hopper according to claim 1, wherein the wear plates arrangement covers at least an impact area of the inner wall of the lower shell part.

9. A blast furnace comprising a charging device comprising one or more material hoppers as claimed in claim 1.

* * * * *